United States Patent [19]

Linstromberg

[11] Patent Number: 4,475,357

[45] Date of Patent: Oct. 9, 1984

[54] ICE PRODUCTION RATE SELECTOR FOR ICE MAKER

[75] Inventor: William J. Linstromberg, Lincoln Township, Berrien County, Mich.

[73] Assignee: Whirlpool Corporation, Benton Harbor, Mich.

[21] Appl. No.: 423,737

[22] Filed: Sep. 27, 1982

[51] Int. Cl.[3] ..... F25C 1/00

[52] U.S. Cl. ..... 62/157; 62/233

[58] Field of Search ..... 62/233, 157, 155, 234

[56] References Cited

U.S. PATENT DOCUMENTS

| | | | |
|---|---|---|---|
| 3,423,949 | 1/1969 | Leeson et al. . | |
| 3,449,919 | 6/1969 | Fox . | |
| 3,459,005 | 8/1969 | Sorensen . | |
| 3,648,478 | 3/1972 | Linstromberg . | |
| 3,714,794 | 2/1973 | Linstromberg . | |
| 3,964,270 | 6/1976 | Dwyer . | |
| 4,197,717 | 4/1980 | Schumacher | 62/233 X |
| 4,292,812 | 10/1981 | Kakinuma et al. . | |

*Primary Examiner*—William E. Tapolcai

*Attorney, Agent, or Firm*—Wood, Dalton, Phillips, Mason & Rowe

[57] ABSTRACT

A refrigeration apparatus having an ice making mechanism disposed in a refrigerated space and including an ice harvesting mechanism. The mechanism includes a thermostat responsive to the temperature of the refrigerated space for controlling operation of the refrigeration apparatus. A control is provided for selectively causing operation of the ice harvesting mechanism alternatively as a function of total clock time from a preceding ice harvesting cycle, or as a function of an accumulated time of operation of the refrigeration apparatus as controlled by the thermostat. In one form, a manually controlled selector switch is provided. In another form, the selector switch is automatically controlled by the setting of the refrigeration apparatus thermostat. In another form, the selector switch is made to be automatically responsive to a temperature condition within the refrigeration apparatus.

14 Claims, 5 Drawing Figures

ICE PRODUCTION RATE SELECTOR FOR ICE MAKER

BACKGROUND OF THE INVENTION

1. Field of the Invention

This invention relates to ice makers and in particular to means for controlling the harvesting of ice bodies from such ice makers.

2. Description of the Prior Art

One example of automatic ice maker presently in wide commercial use is the flexible tray ice maker having control circuitry as disclosed in U.S. Pat. Nos. 3,648,476 and 3,714,794, which patents are owned by the assignee hereof. As disclosed therein, a single timer motor is provided to function both as the defrost cycle timer and as the ice maker mechanism drive motor, whereby ice harvesting operations are preiodically effected.

It is conventional to connect such dual action timer motors so as to be energized continuously and thereby accumulate straight clock time. Alternatively, it has been conventional to energize such timers in such ice maker applications to run intermittently as during operation of the compressor of the refrigerator apparatus only. It is quite common to provide ice maker timing means based on compressor run time, as it is felt that the rate at which ice is formed is correlated substantially with the amount of refrigeration unit run time.

A problem arises in such compressor operation correlated ice maker timers in that the length of the ice making cycle may be excessively long where the compressor is operated infrequently, as during use of the refrigeration apparatus under low ambient temperature conditions. Further, improved efficiency insulation and energy reduction techniques employed in modern refrigeration apparatus cause the compressor run time to be reduced to such an extent that excessively long ice making cycles tend to result. It has been found that under such conditions, an undesirably low amount of ice production per day may result.

It is generally known to provide means for varying the length of a clocked ice making cycle through a manually operable switch. Thus, as shown in U.S. Pat. No. 3,423,949 of Melvin G. Leeson et al, an automatic ice cube maker includes a plurality of time switches which are operated by the timer motor so that any selected switch may be actuated to provide a choice of a 22-minute, 30-minute, or 45-minute ice production cycle followed by a four-minute ice harvest cycle. Thus, the control is arranged to provide any one of a plurality of different straight clock time controls of the ice making cycle.

William L. Fox discloses, in U.S. Pat. No. 3,449,929, a refrigerator with an automatic ice cube maker wherein operation of the ice maker timer motor is effected only when the temperature in the freezer compartment in which the ice maker is disposed is below a predetermined temperature.

Svend E. Sorensen, in U.S. Pat. No. 3,459,005 shows a selective control for an ice maker wherein an analog ice making apparatus is selectively provided with different amounts of heat during the ice making cycle so as to retard the formation of ice in the analog apparatus while allowing the main ice maker to continue to make ice in the normal manner. When the analog apparatus produces a preselected amount of ice therein, the control causes discontinuation of ice making operation of the entire mechanism and permits harvesting of ice from the main ice maker. Resultingly, the size of the ice bodies being formed in the main ice maker is a function of the selective control of the analog ice maker.

In U.S. Pat. No. 3,648,478, which patent is owned by the assignee hereof, William J. Linstromberg discloses a defrost circuit for a refrigerator. In one embodiment, the control provides continuous operation of the ice maker timer. In a different embodiment, the control provides operation of the timer only when the thermostat has closed to cause the compressor of the refrigeration apparatus to run. A defrost switch is provided for automatically connecting the timer motor for operation through the compressor motor windings during a defrost operation and for independent continuous operation during the normal refrigeration operation of the apparatus.

Thomas A. Dwyer discloses, in U.S. Pat. No. 3,964,270, an ice making machine. The apparatus includes a control having a thermostatic switch connected to a manually adjustable timer for automatically controlling the operation of the ice making machine to insure that the water to be frozen is maintained at a freezing temperature for a period of time sufficient to form the desired ice.

In U.S. Pat. No. 4,292,812 of Mitsuru Kakinuma et al, the refrigeration system includes a control device having a timer circuit selectively operable simultaneously with, or with a delay after, the start of an ice making operation to provide control of the period of time during which ice making is effected. A temperature sensing element defines an impedance which varies with variations of the ambient temperature for controlling the period of time during which an ice making operation is performed, thereby to cause the thickness of the ice being made to be constant at all times.

U.S. patent application Ser. No. 424,491, now U.S. Pat. No. 4,424,683, of Larry Manson, which application is assigned to the assignee hereof, discloses an electronically controlled ice maker in which the length of an ice making cycle is varied as a function of the sensed temperature and the operation of the refrigeration means.

SUMMARY OF THE INVENTION

The present invention comprehends an improved control for use with a ice maker apparatus operated by a timer motor. In particular, the invention comprehends the provision of means for selectively placing an ice maker timer motor either in series or in parallel with the refrigeration apparatus thermostat to provide selectively either intermittent or continuous operation of the timer in controlling the length of the ice making cycles.

In one embodiment, the control includes a manually operable selector switch whereby the user can select the desired mode of operation.

In another embodiment, the control means includes means for automatically switching the timer between intermittent and continuous operating modes as a function of the user setting of the refrigeration apparatus thermostat.

In still another embodiment, the control comprises means for automatically switching the ice maker timer between series or parallel connection with a thermostat in response to the temperature of the compartment in which the ice maker is located.

Thus, in broad aspect, the invention comprehends an improved ice maker control for providing an ice making cycle length which is a function of either compressor run time or clock time, as selected by the user.

More specifically, the invention comprehends the provision in a refrigeration apparatus of control means for causing operation of the ice maker harvesting means for harvesting of ice from the ice making mechanism alternatively (a) as a function of the total time from a preceding ice harvesting cycle, or (b) as a function of an accumulated time of operation of the refrigerating means from a preceding ice harvesting cycle.

The ice maker control of the present invention is extremely simple and economical of construction while yet providing an improved rate of ice production under operating conditions where the ice production rate tends to fall off. In addition, the invention allows the user to select a desired mode of ice maker operation.

BRIEF DESCRIPTION OF THE DRAWINGS

Other features and advantages of the invention will be apparent from the following description taken in connection with the accompanying drawings wherein.

DESCRIPTION OF THE PREFERRED EMBODIMENTS

Figure 1:
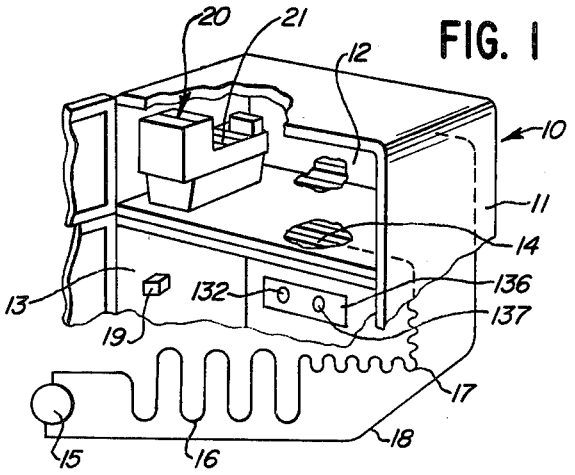
FIG. 1 is a fragmentary perspective view illustrating a refrigeration apparatus having an improved ice maker control embodying the invention.
Figure 4:
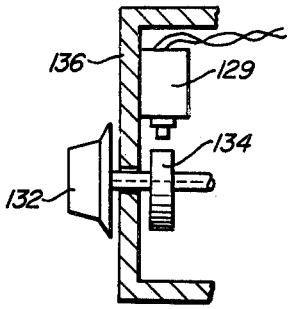
FIG. 4 is a fragmentary section illustrating the selector control of the control circuit of FIG. 3.

In the illustrative embodiment of the invention as disclosed in the drawing, a refrigeration apparatus generally designated 10 is shown to comprise a refrigerator-freezer apparatus having a cabinet 11 defining a freezer space 12 which is maintained at below-freezing temperatures, and an above-freezing fresh food space 13. Refrigeration of spaces 12 and 13 is effected by heat exchange with an evaporator 14 which is connected in a conventional refrigeration circuit including a compressor 15, a condenser 16, a flow restrictor 17, and a suction return line 18 serially interconnected with the evaporator, as shown in FIG. 1.

Operation of the compressor 15 is conventionally effected by means of a cabinet thermostat 19 located in the fresh food space 13 so as to maintain the temperature of space 13 between preselected limits. At the same time, the greater heat transfer association of the evaporator 14 with the freezer space 12 causes the freezer space to be maintained at the below-freezing temperature.

As further illustrated in FIG. 1, an ice maker generally designated 20 is disposed in freezer space 12 for automatically making ice bodies. The ice maker includes an ice making mechanism 21 including a timer motor 22 which is connected in a control circuit 23 for controlling the operation of the refrigeration apparatus 10.

Figure 2:
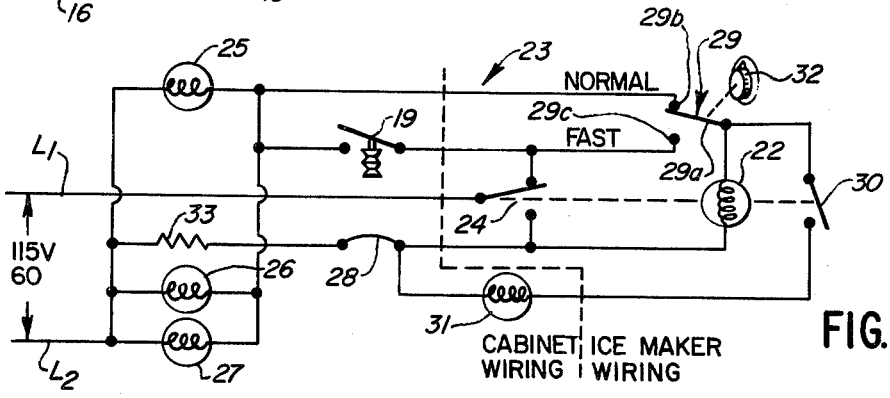
FIG. 2 is a schematic wiring diagram illustrating one control circuit embodying the invention.

Timer motor 22 not only times the operation of ice maker 20, but further serves as the drive means for the mechanism 21, which includes means for harvesting ice from the ice maker. Control circut 23, as shown in FIG. 2 is connected to conventional power supply leads L1 and L2, such as defined by a 115 volt, 60-cycle conventional alternating current power supply. Power supply lead L1 is connected through a timer-operated, single pole, double throw defrost switch 24 and cabinet thermostat switch 19 to a parallel connection of an evaporator fan 25, a condenser fan 26, and the compressor motor 27. The other side of fans 25 and 26 and motor 27 are connected to power supply lead L2, as shown in FIG. 2.

Defrost switch 24 is selectively connected through a defrost bimetal switch 28 to a defrost heater 33, which in turn is connected to the power supply lead L2.

Timer motor 22 is connected from switch 24 to the moving contact **29*a* of a selector switch 29. The timer motor is connected in parallel with a series connection of a timer-operated water valve switch 30 and a water valve solenoid 31** for controlling delivery of water to the ice maker mechanism in effecting the successive ice making cycles.

As further shown in FIG. 2, moving contact **29*a* of selector switch 29 is selectively engageable with a first fixed contact 29*b* or a second fixed contact 29*c* by manipulation of a control knob 32. Thus, when selector switch moving contact 29*a* is in the normal position shown in FIG. 2 in engagement with fixed contact 29*b*, timer motor 22 is energized through the cabinet thermostat switch 19 and, thus, the ice making cycle is dependent on the amount of run time of the compressor 15. However, when the selector switch is thrown to engage fixed contact 29*c* by suitable manual operation of control knob 32, the timer motor 22 is connected directly from power supply lead L1 through switch 24**, thus causing the timing of the ice making cycle to be straight clock time and, thus, a fast timing cycle.

Illustratively, in one form of ice making apparatus utilizing the control circuit 23, 2.7 pounds of ice bodies were provided during a 24-hour period where the running time of compressor 15 was 12 hours during that period, with the selector switch 29 thrown to the normal position illustrated in FIG. 2. However, with the control switch 29 thrown to the fast position, approximately 5.3 pounds of ice bodies were produced in a 24-hour period, with the compressor 15 similarly operating during 50 percent of the time.

Defrosting of the refrigeration apparatus is effected by energization of the defrost heater 33, which, as indicated above, is connected in series with the timer motor 22. The defrosting operation occurs, illustratively, every 9.6 hours of running time of the compressor where the selector switch 29 is in the normal position, and every 9.6 hours of clock time where the selector switch 29 is in the fast position. Resultingly, refrigeration apparatus 10 will tend to operate with higher energy efficiency when selector switch 29 is in the normal position, in that fewer defrost operations occur over a given time period.

Figure 3:
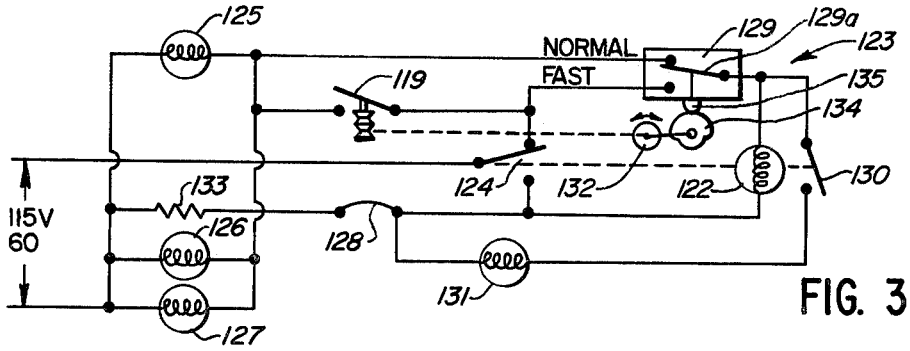
FIG. 3 is a schematic wiring diagram illustrating another form of control circuit embodying the invention.

Referring to the embodiment of FIG. 3, a modified form of control circuit generally designated 123 is shown to comprise a control circuit generally similar to control circuit 23, but wherein the control knob 132 controls both the setting of the cabinet thermostat switch 119 and the selector switch 129. Thus, as shown in FIG. 3, the selector switch is operable by means of a cam 134 selectively positionable by the control knob 132 and acting against a cam follower 135 associated with the moving contact 129a of the selector switch 129 for effecting the desired positioning of the selector switch as a function of the setting of the thermostat 119 by the user. The cam 135 is arranged such that when control knob 132 is adjusted to provide a lower temperature in the refrigeration apparatus, as by causing greater operation time of the compressor 15, cam 134 is then positioned to throw switch 129 to the fast position. Where the thermostat is reversely adjusted by manipulation of the control knob 132, the cam 134 causes the switch 129 to be thrown to the normal position.

As illustrated in FIG. 1, control knob 132 may be provided in a control console 136 which is further provided with a conventional air baffle control knob 137 for adjusting the air flow between the freezer and fresh food compartments, as desired.

In the illustrated embodiment, the selector switch 129 comprises a snap-action switch so as to assure that the switch is positively thrown to either of the fast or normal positions by the selective positioning of the cam 134.

In all other respects, control circuit 123 is similar to control circuit 23 and functions in a similar manner. Elements of control circuit 123 similar to those of control circuit 23 are identified by the same reference numeral but 100 higher.

Figure 5:
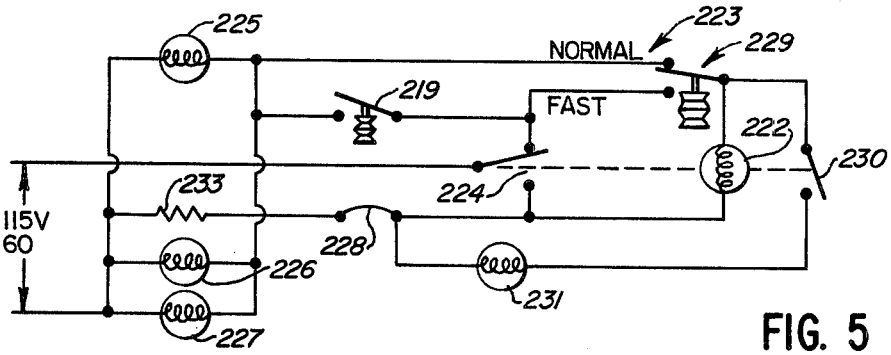
FIG. 5 is a schematic wiring diagram illustrating still another form of control circuit embodying the invention.

Referring now to the embodiment of FIG. 5, a control circuit generally designated 223 is shown to comprise a control circuit generally similar to control circuit 23 but wherein means are provided for automatically switching the selector switch 229 between the normal and fast positions. As shown therein, the selector switch 229 is controlled by a bellows-type thermostat actuator 238, which may be located in the freezer space 12 adjacent the ice maker apparatus 20 for automatically switching the ice maker control between the normal and fast modes. Illustratively, the bellows 238 may be preselected to cause switching of the selector switch 229 to the fast position when the temperature is at or below 5° F., and in the normal position where the temperature is above 5° F. Preferably, the bellows actuator has a small temperature differential hysterisis characteristic, such as in the order of 2° F.

In all other respects, control circuit 223 is similar to and functions similarly to control circuit 23. Elements of control circuit 223 which are similar to elements of control circuit 23 are identified by similar reference numerals but 200 higher.

Thus, the invention comprehends improved ice maker control means permitting the user to select fast or normal modes of ice maker cycling. The modes are based on operation of the ice maker as a function of compressor run time or straight clock time, as selected. In one form of the invention, the user manually effects selection of the two modes by control of a suitable selector switch. In another form of the invention, the selection of the ice maker cycle modes is effected automatically as a function of the setting of the cabinet thermostat. In still another form, the invention comprehends the provision of means for automatically controlling the setting of the selector switch as the function of a sensed temperature condition, such as the temperature of the freezer compartment adjacent the ice maker.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having an ice making mechanism disposed in a refrigerated space and including ice harvesting means, refrigeration means for refrigerating said space, means responsive to the temperature of said space for controlling operation of said refrigeration means, and means for operating said ice making mechanism as a function of an accumulated time of operation of said refrigeration means, the improvement comprising control means for causing selectively increased operation of said ice harvesting means for harvesting of ice from said ice making mechanism by switching operation of said ice making mechanism to effect such harvesting as a function of total elapsed time.

2. The refrigeration apparatus of claim 1 wherein sad refrigerated space includes a below-freezing freezer portion and an above-freezing fresh food portion, said ice making mechanism being disposed in said freezer portion and said temperature responsive means being in heat transfer association with said fresh food portion.

3. The refrigeration apparatus of claim 1 wherein said control means includes a manually operable selector switch for switching said operation from said accumulated refrigeration time harvesting.

4. In a refrigeration apparatus having an ice making mechanism disposed in a refrigerated space and including ice harvesting means, refrigeration means for refrigerating said space, thermostat means for setting a desired operating temperature of said apparatus, and means responsive to the temperature of said space for controlling operation of said refrigeration means, the improvement comprising selective control means for causing operation of said ice harvesting means for harvesting of ice from said ice making mechanism selectively (a) as a function of total elapsed time, or (b) as a function of an accumulated time of operation of said refrigeration means, said temperature responsive means being adjustable and said control means comprising selector means which is operated as a function of the setting of said thermostat means.

5. In a refrigeration apparatus having an ice making mechanism disposed in a refrigerated space and including ice harvesting means, refrigeration means for refrigerating said space, and means responsive to the temperature of said space for controlling operation of said refrigeration means, the improvement comprising selective control means for causing operation of said ice harvesting means for havesting of ice from said ice making mechanism selectively (a) as a function of total elapsed time, or (b) as a function of an accumulated time of operation of said refrigeration means, said temperature responsive means comprising a thermostatic switch, and said control means including a temperature responsive switch for selectively connecting said harvesting means (a) in parallel with said thermostatic switch, or (b) in series therewith.

6. The refrigeration apparatus of claim 5 wherein said temperature responsive switch is located adjacent said ice making mchanism.

7. In a refrigeration apparatus having an above-freezing compartment and a below-freezing compartment, an ice making mechanism disposed in said below-freezing compartment and including ice harvesting means, a timer motor for timing the ice making cycles of said mechanism and effecting operation of said harvesting means, refrigeration means for refrigerating said compartments, control means including a thermostat in said above-freezing compartment responsive to the temperature thereof for controlling operation of said refrigeration means, and means for operating said ice making mechanism as a function of an accumulated time of operation of said refrigeration means effected by operation of said thermostat from a preceding ice harvesting cycle, the improvement comprising means for selectively causing increased frequency of ice maker operation when a condition of operation of the refrigeration apparatus tends to reduce said frequency comprising means for operating said ice harvesting means to harvest ice from said ice making mechanism as a function of total elapsed time from a preceding ice harvesting cycle.

8. In a refrigeration apparatus having an above-freezing compartment and a below-freezing compartment, an ice making mechanism disposed in said below-freezing compartment and including ice harvesting means, a timer motor for timing the ice making cycles of said mechanism and effecting operation of said harvesting means, refrigeration means for refrigerating said compartments, and control means including a thermostat in said above-freezing compartment responsive to the temperature thereof for controlling operation of said refrigeration means, the improvement comprising selector switch means operatively associated with said control means for causing operation of said timer motor for operating said ice harvesting means to harvest ice from said ice making mechanism alternatively (a) as a function of total elapsed time from a preceding ice harvesting cycle, or (b) as a function of an accumulated time of operation of said refrigeration means effected by operation of said thermostat from a preceding ice harvesting cycle, said thermostat comprising a manually adjustable thermostat and said selector switch means including means for selectively setting said selector switch mens as a function of the setting of said thermostat.

9. In a refrigeration apparatus having an above-freezing compartment and a below-freezing compartment, an ice making mechanism disposed in said below-freezing compartment and including ice harvesting means, a timer motor for timing the ice making cycles of said mechanism and effecting operation of said harvesting means, refrigeration means for refrigerating said compartments, and control means including a thermostat in said above-freezing compartment responsive to the temperature thereof for controlling operation of said refrigeration means, the improvement comprising:

selector switch means operatively associated with said control means for causing operation of said timer motor for operating said ice harvesting means to harvest ice from said ice making mechanism alternatively (a) as a function of total elapsed time from a preceding ice harvesting cycle, or (b) as a function of an accumulated time of operation of said refrigeration means effected by operation of said thermostat from a preceding ice harvesting cycle;

means for sensing the temperature of said below-freezing compartment; and means associated with said selector switch for selectively setting said selector switch in response to the second temperature of said below-freezing compartment.

10. The refrigeration apparatus of claim 7 wherein said thermostat comprises a manually adjustable thermostat and said selector switch means includes cam means for selectively setting said selector switch means as a function of the setting of said thermostat.

11. In a refrigeration apparatus having an ice making mechanism including means for cyclically harvesting ice, a control for causing operation of said ice making mechanism at a first frequency of ice harvesting, and refrigeration means, the improvement comprising control means for causing the frequency of harvesting operation of said ice making mechanism to be selectively increased from said first frequency to a second higher frequency as an inverse function of a temperature condition associated with the refrigeration apparatus.

12. In a refrigeration apparatus having an ice making mechanism including means for cyclically harvesting ice, and refrigeration means, the improvement comprising control means for causing operation of said ice making mechanism for causing the ice time between harvesting operations to be alternatively (a) a function of total time from a preceding ice making cycle, or (b) a function of an accumulated time of operation of said refrigeration means from a preceding ice making cycle, said control means comprising means responsive to a temperature condition produced by said refrigeration means for automaticlly causing said control means to effect said alternative operation of the ice making mechanism.

13. In a refrigeration apparatus having means defining a refrigerated compartment, refrigeration means for refrigerating said compartment, a thermostatic switch for connecting said refrigeration means to a power source in response to a sensed temperature, and an ice making mechanism disposed in said compartment and including a timer motor for operating said mechanism to effect periodic ice harvesting operations, the improvement comprising:

means connecting a first terminal of said timer motor to a first terminal of said power source; and, a selector switch connected to a second terminal of said timer motor, said selector switch being movable between a first position connecting said second timer motor terminal substantially directly to a second terminal of said power source for continuous operation of said timer motor, and a second position connecting said second timer motor terminal to said second terminal of said power source in series with said thermostatic switch for operation of said timer motor only when said refrigeration means is operating.

14. The refrigeration apparatus of claim 13 wherein said timer motor operates a defrost switch having a run position and a defrost position and wherein said timer motor second terminal is connected to said power source second terminal in series with said defrost switch when said selector switch is in said first position.

* * * * *